United States Patent [19]

Maroschak

[11] 3,958,425

[45] *May 25, 1976

[54] CORRUGATED PLASTIC DRAINAGE PIPE WITH INTEGRAL COUPLER

[75] Inventor: Ernest J. Maroschak, Roseboro, N.C.

[73] Assignee: Plastic Tubing, Inc., Roseboro, N.C.

[ * ] Notice: The portion of the term of this patent subsequent to July 29, 1992, has been disclaimed.

[22] Filed: Dec. 5, 1973

[21] Appl. No.: 421,977

Related U.S. Application Data

[63] Continuation-in-part of Ser. No. 228,508, Feb. 23, 1972, Pat. No. 3,802,202, and a continuation-in-part of Ser. No. 254,934, May 19, 1972, and a continuation-in-part of Ser. No. 352,245, April 18, 1973.

[52] U.S. Cl. ..... 61/11; 138/121; 285/14; 285/260; 285/DIG. 4; 285/DIG. 22

[51] Int. Cl.[2] ..... F16L 31/00; F16L 47/00

[58] Field of Search ..... 285/DIG. 4, 260, 176, 285/235, 423, 175, DIG. 22, 14; 61/11, 10, 12; 138/121

[56] References Cited

UNITED STATES PATENTS

| | | | |
|---|---|---|---|
| 559,642 | 5/1896 | Watson | 285/DIG. 4 |
| 955,847 | 4/1910 | Carmean | 61/10 |
| 1,055,674 | 3/1913 | Smith | 61/11 |
| 3,076,669 | 2/1963 | Schlein | 285/423 X |
| 3,212,799 | 10/1965 | Rice | 285/423 X |
| 3,695,643 | 10/1972 | Schmunk | 285/DIG. 4 |
| 3,747,352 | 7/1973 | Maroschak | 61/10 |
| 3,785,682 | 1/1974 | Schaller et al. | 285/DIG. 4 |
| 3,794,364 | 2/1974 | Williams | 285/DIG. 4 |
| 3,825,288 | 7/1974 | Maroschak | 285/DIG. 4 X |

FOREIGN PATENTS OR APPLICATIONS

| | | | |
|---|---|---|---|
| 906,874 | 9/1962 | United Kingdom | 285/235 |
| 1,247,652 | 10/1960 | France | 285/260 |

*Primary Examiner*—Thomas F. Callaghan
*Attorney, Agent, or Firm*—Bell, Seltzer, Park & Gibson

[57] ABSTRACT

A corrugated plastic drainage pipe having a coupler integrally formed at one end thereof and wherein the coupler is in the form of an enlarged collar having an inner diameter and length so as to receive the end of a connecting pipe therein and having a plurality of spaced latching members integrally formed with and extending radially inwardly from the inner surface of the collar. The collar has sufficient flexibility and resiliency so that when the end of a corrugated pipe is inserted in the collar the latching member may be outwardly displaced momentarily with respect to one another for facilitating making the interconnection, and thereafter return and engage the ribs of the corrugated pipe and provide a releasable connection therewith.

18 Claims, 10 Drawing Figures

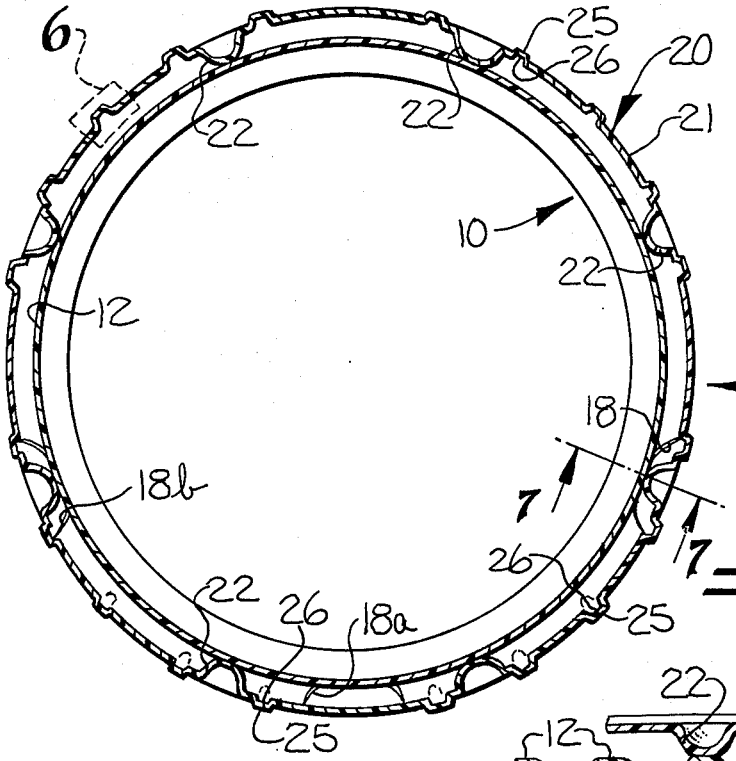
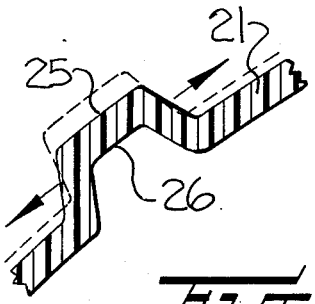
Fig-6
Fig-5
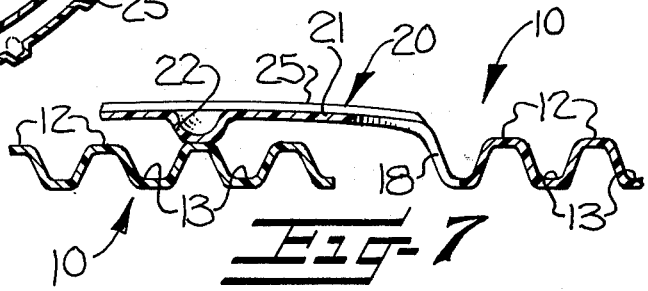
Fig-7
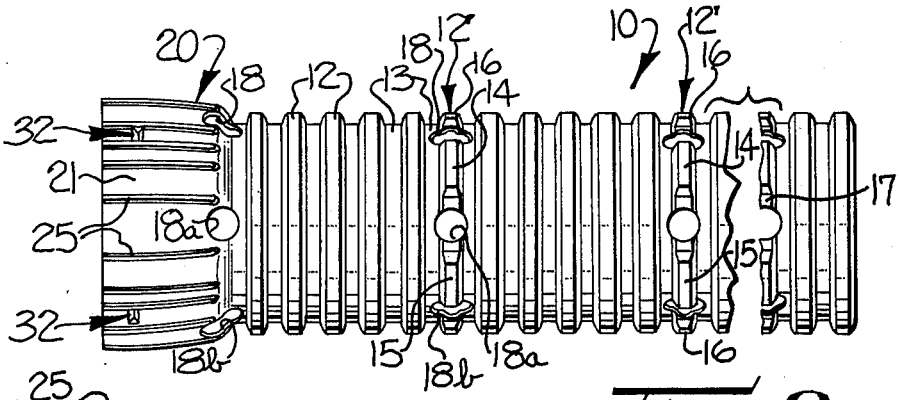
Fig-8
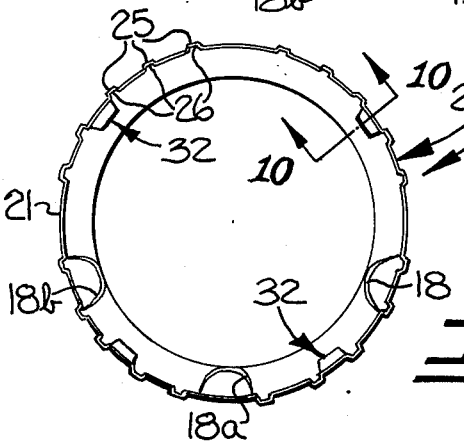
Fig-9
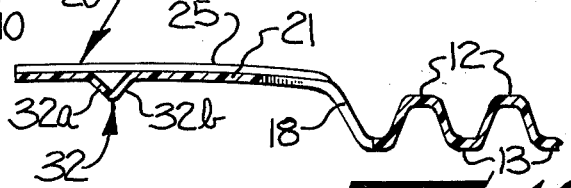
Fig-10

CORRUGATED PLASTIC DRAINAGE PIPE WITH INTEGRAL COUPLER

This application is a continuation-in-part of my copending application Ser. No. 228,508, filed Feb. 23, 1972 entitled CORRUGATED DRAINAGE PIPE now U.S. Pat. No. 3,802,202 issued Apr. 9, 1974, and a continuation-in-part of my copening application Ser. No. 254,934, filed May 19, 1972 entitled CORRUGATED PLASTIC PIPE WITH INTEGRALLY FORMED COUPLER, and also a continuation-in-part of my copending application Ser. No. 352,245, filed Apr. 18, 1973 entitled COUPLING FOR INTERCONNECTING CORRUGATED PLASTIC TUBES.

Corrugated plastic drainage pipes have heretofore been interconnected in end-to-end relation by the use of separate fittings which are attached to the ends of the pipes during installation. The use of such fittings is time consuming in that it requires a separate manual operation of attaching the fittings to the pipe each time two pipes are to be interconnected, and is expensive since it is necessary to additionally purchase the separate fittings and to maintain a substantial inventory thereof at the job site, where they are subject to loss or pilferage.

In my aforementioned copending application Ser. No. 254,934, filed May 19, 1972, entitled CORRUGATED PLASTIC PIPE WITH INTEGRALLY FORMED COUPLER, there is disclosed a corrugated plastic drainage pipe which overcomes the disadvantages of using separate fittings by providing an integrally formed coupler at one end of a corrugated plastic pipe. The integral coupler is adapted to receive and to interconnect with the opposite non-modified end of another like corrugated pipe, and employs a plurality of spaced latching members extending inwardly from the coupler for engaging the ribs of the pipe in the coupler.

In accordance with the present invention, I have improved the structure of the integrally formed coupler disclosed in my copending application Ser. No. 254,934 so as to provide a number of significant advantages thereover.

For example, I have discovered that the relative ease by which a pipe may be inserted in a coupler and the effectiveness of the connection obtained may be improved by increasing the flexibility of the outer portion of the coupler wall and by locating the latching members in this outer, more flexible portion of the coupler. Thus, the latching members may be easily displaced radially outwardly when inserting the ribs of a pipe against the latching members, and will resiliently return to their original position after the pipe is inserted to securely but releasably engage the pipe in the integral coupler. This increased flexibility in the outer portion of the coupler may be effected by providing a coupler wall which tapers toward the free end of the coupler.

I have also found that improved latching engagement between the integral coupler and a pipe may be provided by forming the latching members of a relatively small, symmetrical construction whereby the latching members are substantially rigid and cause outward deflection of surrounding wall portions of the collar when inserting the ribs of a pipe beyond the latching members. Additionally, by forming the latching members of this relatively small, symmetrical construction, the pipe remains freely rotatable in the coupler so as to permit easily aligning the drainage holes in their proper orientation during installation after forming the connection between pipes. Latching members of this type are employed in the coupling disclosed in my aforementioned copending U.S. Pat. application Ser. No. 352,245 filed Apr. 18, 1973, entitled COUPLING FOR INTERCONNECTING CORRUGATED PLASTIC TUBES.

I have further found that the flexibility of the coupler and also the radial expansibility thereof may be increased by forming relatively narrow longitudinally extending ribs on the outer surface of the coupler with corresponding grooves on the inner surface of the coupler. These ribs and grooves provide flexure lines in the wall of the coupler which permit the coupler to more easily flex or stretch to thereby allow a pipe to be easily inserted in the coupler and effectively retained therein.

With the foregoing in mind, it is a primary object of this invention to provide a corrugated plastic drainage pipe having integrally formed at one end thereof a coupler of an improved structure adapted for being easily interconnected with the corrugated end of another like pipe and thus forming an effective connection between the pipes.

It is a more specific object of this invention to form a coupler integral with one end of a corrugated plastic drainage pipe wherein the wall thickness of the coupler is thinner at the outer end thereof than at the inner end so as to provide additional flexibility in the outer portion of the coupler, and wherein a plurality of spaced latching members are provided extending inwardly from the coupler around the outer more flexible portion thereof, whereby the latching members are displacable outwardly with respect to one another for facilitating inserting the end of a corrugated pipe within the coupler and providing a releasable connection therebetween.

It is a further more specific object of this invention to provide a coupler integrally formed on the end of a corrugated plastic drainage pipe wherein the coupler has a plurality of latching members extending inwardly therefrom for releasably engaging the end of another like pipe, and wherein a plurality of narrow, longitudinally extending ribs are formed in spaced apart relation on the exterior surface of the collar and defining corresponding grooves on the inner surface of the collar with the ribs and grooves providing flexure lines in the wall of the collar which serve to increase the flexibility and the radial expansibility of the collar so as to facilitate inserting the end of a corrugated pipe within the collar and forming a releasable connection therebetween.

Some of the objects and advantages of the invention having been stated, others will appear when taken in connection with the accompanying drawings, in which FIG. 1 is a top plan view of several interconnected drainage pipes in accordance with the invention;

FIG. 5 is an enlarged vertical sectional view taken substantially along line 5—5 of FIG. 4, but shown with the corrugated pipe only partially inserted in the coupler and with the latching members of the coupler bearing against a rib of the pipe;

FIG. 6 is a detailed view of the portion of the pipe shown in FIG. 5 within the dashed lines;

FIG. 7 is an enlarged sectional view taken along the line 7—7 in FIG. 5;

FIG. 8 is a bottom plan view showing the underside of a drainage pipe in accordance with a second form of the invention;

FIG. 9 is an end view of the drainage pipe of FIG. 8, but shown with the drainage holes located in their normal orientation lowermost in the pipe; and FIG. 10 is an enlarged sectional view taken along line 10—10 of FIG. 9.

Figure 1:
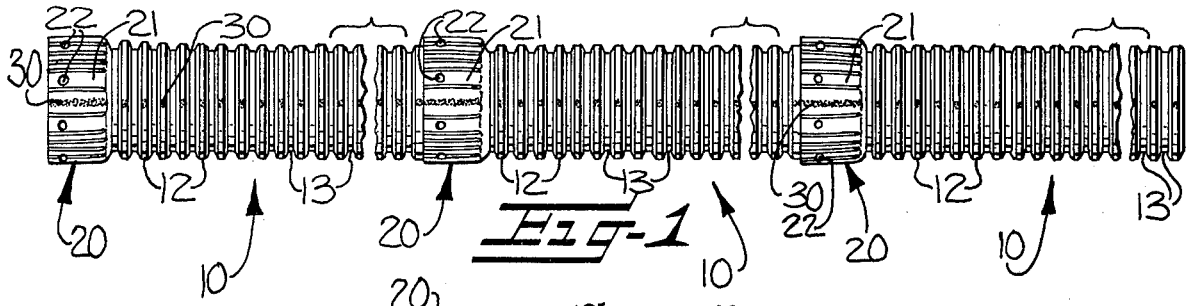

Referring now more specifically to the drawings, and particularly to the first form of the invention illustrated in FIGS. 1–7, reference numeral 10 broadly indicates a molded corrugated resilient drainage pipe formed of polyethylene, for example, and wherein a coupler, broadly indicated by the reference numeral 20, is integrally molded on one end of the pipe and wherein the remainder of the pipe is defined by successive annular ribs 12 and annular valley portions 13.

As illustrated, certain of the annular ribs 12 are uninterrupted and successively arranged in spaced groups of five with an interrupted rib 12' between adjacent groups. Each interrupted rib 12' comprises a set of three circularly arranged spaced arcuate rib segments, as indicated by numerals 14, 15 and 16, respectively, with the respective rib segments forming each of the interrupted ribs 12' being correspondingly arranged throughout the pipe so as to be in longitudinal alignment with each other. Recessed wall portions or plateaus 17 extend between and interconnect adjacent arcuate rib segments 14, 15 and 16 respectively, with the peripheries of the recessed wall portions 17 being positioned at a level intermediate the peripheries of the ribs 12 and valley portions 13.

Figure 2:
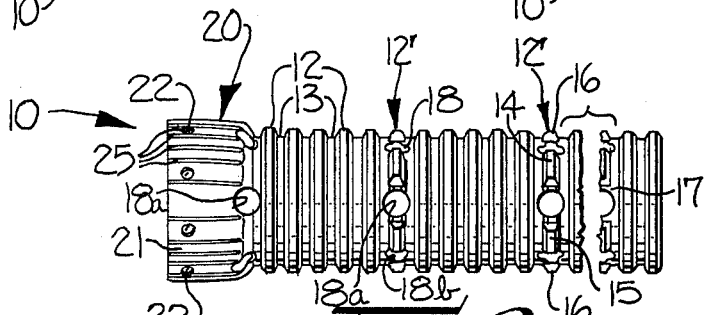
FIG. 2 is a bottom plan view of a drainage pipe showing the underside thereof.

As seen from FIG. 2, rib segment 16 is longer than the other two rib segments 14, 15 and has an arcuate extent encompassing at least the upper half of the drainage pipe, i.e., at least 180°. The shorter rib segments 14 and 15 are preferably of the same length and each have an arcuate extent of about 40° to 45° and are located in the lower half of the drainage pipe.

As shown in the drawings, the pipe is in the form of a drainage pipe and is provided with a series of three drainage holes, indicated by the reference numerals **18, 18*a*, and 18*b*, which are located in and extend through the recessed wall portions 17 in the corrugated portion of the pipe. As illustrated, holes 18, 18*a*, 18*b* are of a diameter which is greater than the width of the ribs 12**.

For aiding in properly installing the drainage pipe in the ground with the drainage holes positioned lowermost, sight means 30 (FIG. 1), which is preferably in the form of a painted line contrasting with the color of the pipe, is provided on the upper surface of the pipe in diametrically opposed relation with the center drainage hole 18a in the lower half of the pipe.

Since corrugated plastic pipe is also used for various purposes without drainage holes being provided therein, it may in some instances be economically desirable to omit the drainage holes from the recessed wall portions 17 and to thereby employ the same molding apparatus for forming solid or unperforated pipe as for forming pipe having holes therein.

Referring now more specifically to the construction of the coupler 20, it will be noted that the coupler comprises an enlarged annular collar 31 having an inner diameter and length of proper size for receiving therein at least one of the ribs 12 of a connecting pipe. Thus, as illustrated, the collar has an inner diameter at the mouth or outer end thereof which is greater than the diameter of the ribs 12, and the diameter of the collar is sufficiently large throughout at least the major portion of the axial length of the collar so that at least one, and preferably several of the ribs at the end of a connecting pipe 12 may be received within the collar.

Integrally formed with the collar 21 and extending radially inwardly from the inner surface thereof are a plurality of spaced latching members 22. The latching members are preferably positioned in a circular arrangement with the radial distance from the inner end of each latching member 22 to the axis of the collar 21 being less than the radius of the ribs 12 so that collectively the inner ends of the latching members define an imaginary circle of a diameter less than the outer diameter of the ribs 12. Thus, when a corrugated pipe is received in the coupler 20 the latching members 22 extend inwardly and engage the sidewall portion of a rib of the pipe in the coupler, while permitting rotation of the pipe for positioning the drainage holes in their proper orientation in the lower half of the pipe.

As illustrated, the latching members 22 are spaced inwardly a short distance from the outer end or mouth of the coupler. Preferably, the latching members are inset a distance corresponding to about the width of a rib of the pipe to facilitate positioning the pipe in the mouth of the coupler when effecting a connection. As also illustrated, the annular collar 21 is of a length sufficient to receive about three ribs of an interconnected pipe, with two of the ribs preferably being positioned behind the latching members 22 to aid in preventing inadvertent disconnection of the pipe from the coupler.

To also aid in inserting a pipe in the coupler and forming a connection therebetween, it will be noted that collar 21 is flared substantially uniformly along its length so that the inside diameter of the coupler adjacent the outer end thereof is greater than the inside diameter of the coupler at the inner end thereof adjacent the corrugated portion of the pipe. The wedging effect of the innermost portion of the flared coupler against the interconnected pipe also facilitates obtaining a secure connection by reducing or eliminating unwanted movement or play between the coupler and the interconnected pipe.

Figure 4:
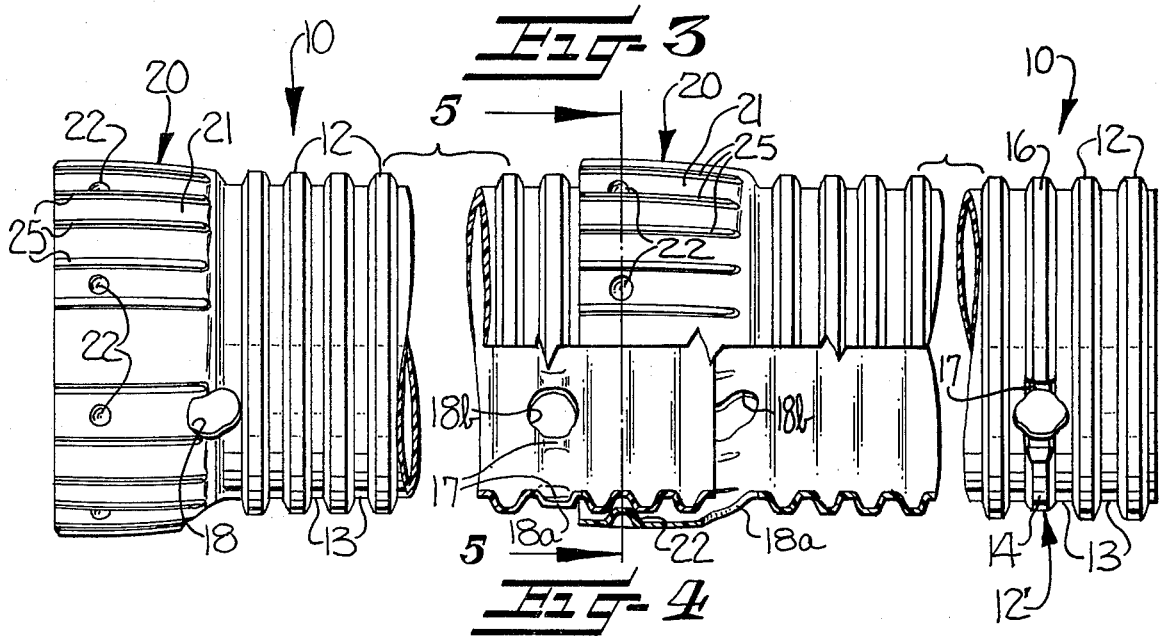
FIG. 4 is a side elevational view of two interconnected drainage pipes, with parts thereof broken away and shown in section.

Although the inside diameter of coupler 20 is greater than the outside diameter of the ribs of the pipe, it will be noted from FIG. 4 that because of the relatively thin wall construction of the coupler and close fit between the coupler and the end of a pipe, the outside diameter of the coupler is only slightly larger than the diameter of the ribs of the pipe. The absence of a significant enlargement at the junction of two pipes facilitates obtaining a uniform slope or grade in the pipeline when installing the same underground, as is necessary for obtaining proper drainage of liquids through the pipeline.

Referring now more specifically to the construction of the latching members 22, it will be noted that the latching members 22 are of symmetrical construction about a plane of symmetry extending substantially perpendicular to the axis of the coupler. More particularly, the latching members 22 are generally hemispherical in shape and are of hollow construction so as to form a generally hemispherical projection on the inner surface of the collar and a corresponding depression on the outer surface of the collar 21. The latching members are of relatively small size, e.g. about one-fourth inch in diameter as measured across the base on the inner surface of the collar. The small size of the latching members, together with the hollow, symmetrical construction thereof serves to impart rigidity to the latching members so that the latching members may effectively serve to engage the ribs of an interconnecting pipe without being collapsed or deformed. As illustrated, eight latching members 22 are arranged in opposing pairs in equally spaced relation around the interior surface of the collar 21.

As illustrated in FIG. 4, and in greater detail in FIGS. 7 and 10, the wall thickness of collar portion 21 tapers gradually towards the outer end of the coupler so that the collar is thinner and consequently more flexible in the outer portion thereof while being thicker and less flexible in the inner portion adjacent the corrugated portion of the pipe. Preferably, the wall thickness of the collar at the outer end thereof is from about 0.040 to about 0.060 inches, while the wall thickness in the inner portion of the collar is from about 0.070 to about 0.120 inches. The connecting pipe within the collar provides reinforcement to the collar in the outer, more flexible portion thereof so that there is no decrease in compressive strength of the pipe in this area of reduced wall thickness. As illustrated in FIG. 4, the end of the connecting pipe terminates short of the innermost end of the collar, but the increased wall thickness of the collar in the inner portion thereof provides adequate compressive strength to the collar so that the underlying reinforcement of a connecting pipe is not needed.

The latching members 22, which as previously noted are preferably located a short distance from the outer end of the collar, are therefore carried by the thinner, more flexible portion of the collar and are thereby adapted for being easily displaced outwardly with respect to one another for facilitating inserting the end of a corrugated pipe within the coupler. The resilient nature of the sleeve 21 returns latching members 22 inwardly after a pipe is inserted so that the latching members firmly engage the ribs of the pipe and provide a secure, releasable connection. As previously noted, the small size and symmetrical construction of the latching members serve to provide rigidity to the latching members so that the latching members are not deformed when a pipe is inserted in the coupler but instead cause outward displacement of the more flexible portions of the collar 21 adjacent the latching members.

Referring now more particularly to FIG. 4, it will be noted that a plurality of narrow, longitudinally extending ribs 25 are provided on the exterior of the collar 21. These ribs 25 are of hollow construction and therefore form correspondingly shaped grooves 26 on the inner surface of the collar 21. As illustrated, ribs 25 extend along substantially the entire length of the coupler 20 with the innermost end thereof being tapered or pointed and blending smoothly into the coupler to avoid any exposed sharp edges. Preferably, ribs 25 have a height of about 0.040 to about 0.080 inches and a width of about 0.120 to about 0.160 inches.

As illustrated in FIG. 5, a pipe is shown partially inserted into the coupler 20 of another pipe so that the ribs 12 thereof bear against the latching members 22 of the coupler 20. When a pipe 10 is inserted in a coupler 20 in this manner, or as often occurs during insertion of a pipe, when the pipe is cocked at an angle and rib 12 bears against only some of the latching members 22, the collar 21 must be stretched or expanded radially outwardly to permit the ribs of the pipe to pass beyond the latching members of the coupler. In these instances, longitudinal ribs 25 and their corresponding grooves 26 form flexure lines in the wall of the collar which serve to increase the flexibility and the radial expansibility of the collar for facilitating inserting a pipe in the collar.

The outward radial displacement of the latching members during insertion of a pipe causes the wall of collar 21 to flex and to bow slightly inwardly between adjacent latching members. Thus, as illustrated in FIG. 6, the wall of collar 21 and longitudinal rib 25 are moved or bowed inwardly a short distance from the position shown in the dashed lines to that shown in solid lines. Additionally, the colar diameter is expanded or stretched when a pipe is being inserted therein, and ribs 25 facilitate such expansion since they are partially unfolded or straightened temporarily by the tension forces in the wall of the collar during insertion of the pipe.

Referring to FIG. 5, it will be noted that some of the ribs 25 on collar 21 are positioned in pairs closely adjacent each side of each of the latching members 22. By so positioning the ribs, the latching members are more flexibly carried by collar 21 and more easily displaced outwardly when a pipe is inserted in the collar.

Figure 3:
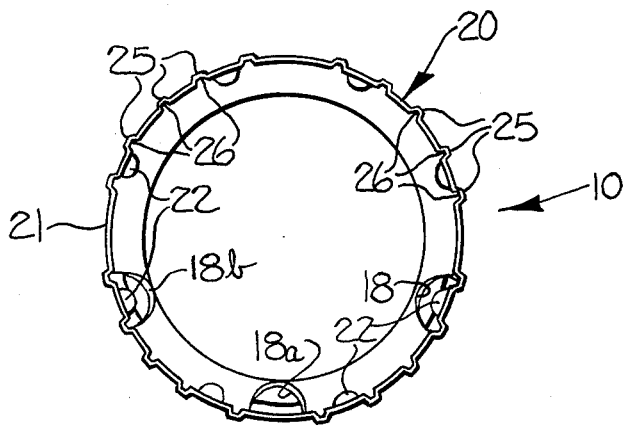
FIG. 3 is an end view of the drainage pipe shown in its normal orientation with the drainage holes positioned lowermost in the pipe.

Referring now to FIGS. 2, 3 and 4, it will be noted that drainage holes are also provided through the wall of the collar 20 at its juncture with the first valley portion 13 of the corrugated portion of the pipe. Locating the drainage holes in this area of increased thickness avoids materially affecting or reducing the compressive strength of the pipe by taking advantage of the increased thickness and consequent higher strength of the collar in this area.

Referring now to the second embodiment of the invention, as illustrated in FIGS. 8–10, it will be noted that this embodiment of the invention differs from the first embodiment only in the arrangement and construction of the latching members. Accordingly, those parts shown in FIGS. 8–10 which correspond to similar parts shown in FIGS. 1–7 will bear the same reference characters to avoid repetitive description and only the differences in the latching members will be described in detail. As illustrated in FIGS. 8–10, the latching members, designated by the reference character 32, are of symmetrical construction about a plane of symmetry extending substantially perpendicular to the axis of the collar, and more particularly are of V-shaped cross section having opposing faces **32*a*, 32*b* inclined at substantially equal angles. The latching members are of hollow form and relatively small in size to thereby impart rigidity thereto to avoid collapsing or deforming the latching members while effecting a connection. The latching members are preferably located in the outer, more flexible portion of the collar and are arranged in opposing pairs in equally spaced apart relation. As illustrated, four latching members are provided, spaced approximately 90 degrees apart around the inner surface of the collar 21.**

From the foregoing, it will be appreciated that the instant invention is directed to a corrugated plastic pipe having a coupler integrally formed therewith, and wherein the integral coupler is adapted for being easily interconnected with the corrugated end of another like pipe for forming an effective connection therewith.

In the drawings and specification there have been set forth preferred embodiments of the invention, and although specific terms are employed, they are used in a generic and descriptive sense only and not for purposes of limitation.

That which is claimed is:

1. A resilient plastic drainage pipe having spaced apart successive annular ribs with annular valley portions therebetween defining corrugations along the periphery of the pipe extending from adjacent one end portion of the pipe and throughout the remainder of the pipe, and coupling means integrally formed with said pipe and defining said one end portion thereof and adapted for releasable connection with the opposite end of another like pipe, said coupling means comprising an enlarged collar having an inner diameter and length so as to receive therein at least one rib at the end of a connecting pipe, the wall thickness of the collar being thinner at the outer end thereof than at the inner end so as to provide additional flexibility in the outer portion of the collar, said collar also having a plurality of spaced latching members integrally formed with and extending radially inwardly from the outer, more flexible portion of said collar, with the radial distance from the inner end of each latching member to the axis of the collar being less than the radius of said ribs, said latching members thereby being outwardly displaceable with respect to one another for facilitating inserting the end of a corrugated pipe within the collar and being resiliently returnable for engaging the ribs of the corrugated pipe and providing a releasable connection therewith.

2. A resilient plastic drainage pipe according to claim 1 wherein said latching members are of hollow rigid construction and are thereby adapted to effect outward displacement of the surrounding relatively flexible portions of said collar when a pipe is inserted therein for facilitating effecting the connection therebetween and to avoid deforming the latching members.

3. A resilient plastic drainage pipe according to claim 2 wherein said latching members are generally hemispherical in shape.

4. A resilient plastic drainage pipe according to claim 2 wherein said latching members are of generally V-shaped cross-section.

5. A resilient plastic drainage pipe according to claim 1 wherein said collar is flared outwardly throughout its length so as to have a greater inside diameter at its outer end than the inner end thereof.

6. A resilient plastic drainage pipe having spaced apart successive annular ribs with annular valley portions therebetween defining corrugations along the periphery of the pipe extending from adjacent one end portion of the pipe and throughout the remainder of the pipe, a plurality of drainage holes in the wall of the pipe positioned at spaced locations throughout said remainder of the pipe with the diameter of said drainage holes being greater than the width of said ribs, and coupling means integrally formed with said pipe and defining said one end portion thereof and being adapted for releasable connection with the opposite end of another like pipe, said coupling means comprising an enlarged collar having an inner diameter and length so as to receive therein at least one rib at the end of a connecting pipe, and with the wall thickness of said collar being thinner at the outer end of the collar than at the inner end thereof to provide additional flexibility in the outer portion of the collar, said collar including latching means integrally formed with and extending generally radially inwardly from the outer, more flexible portion of said collar and adapted for engaging the end portion of a corrugated pipe positioned within said collar, with the flexibility of said collar allowing said latching means to be displaced radially outwardly for facilitating inserting the end of a corrugated pipe within the collar and to resiliently return and engage the ribs of the corrugated pipe for providing a releasable connection therewith.

7. A resilient plastic drainage pipe according to claim 6 including at least one drainage hole in the wall of said collar, with said drainage hole being located in the inner, relatively thick portion of said collar to thereby avoid materially affecting the compressive strength of the coupler.

8. A resilient plastic drainage pipe according to claim 6 further comprising a plurality of narrow, longitudinally extending ribs formed on the exterior surface of said collar and defining corresponding grooves on the inner surface of said collar, said ribs and grooves providing flexure lines in the wall of said collar which serve to increase the flexibility and the radial expansibility of the collar and which thereby facilitate inserting a pipe in the collar.

9. A resilient plastic drainage pipe having spaced apart successive annular ribs with annular valley portions therebetween defining corrugations along the periphery of the pipe extending from adjacent one end portion of the pipe and throughout the remainder of the pipe, and coupling means integrally formed with said pipe and defining said one end portion thereof and adapted for releasable connection with the opposite end of another like pipe, said coupling means comprising an enlarged collar having an inner diameter and length so as to receive therein at least one rib at the end of a connecting pipe, and having a plurality of spaced latching members integrally formed with said collar and extending inwardly from the inner surface of said collar, said latching members being rigid and of symmetrical construction about a plane of symmetry extending substantially perpendicular to the axis of said annular collar with the radial distance from the inner end of each latching member to the axis of the collar being less than the radius of said ribs, said latching members thereby being adapted to frictionally engage the end of a corrugated pipe received in said collar and provide a releasable connection therewith.

10. A resilient plastic drainage pipe according to claim 9 wherein said symmetrical latching members are at least four in number and are circularly arranged around the inner surface of said collar.

11. A resilient plastic drainage pipe according to claim 10 wherein said latching members are spaced inwardly from the mouth of said collar a distance approximately equal to the width of one of the ribs on said pipe to thereby facilitate positioning the end of a corrugated pipe in the mouth of said collar when interconnecting lengths of pipe.

12. A resilient plastic drainage pipe according to claim 9 wherein said latching members are generally hemispherical in shape.

13. A resilient plastic drainage pipe according to claim 9 wherein said latching members are of generally V-shaped cross-section.

14. A resilient plastic drainage pipe having spaced apart successive annular ribs with annular valley portions therebetween defining corrugations along the periphery of the pipe extending from adjacent one end portion of the pipe and throughout the remainder of the pipe, and coupling means integrally formed with said pipe and defining said one end portion thereof and being adapted for releasable connection with the opposite end of another like pipe, said coupling means comprising an enlarged collar having an inner diameter and length so as to receive therein at least one rib at the end of a connecting pipe, and with a plurality of narrow, longitudinally extending ribs being formed in spaced apart relation on the exterior surface of said collar and defining corresponding grooves on the inner surface of the collar, said ribs and grooves providing flexure lines in the wall of said collar which serve to increase the flexibility and the radial expansibility of the collar, said collar having a plurality of spaced latching members integrally formed with and extending radially inwardly from the inner surface of said collar with the radial distance from the inner end of each latching member to the axis of the collar being less than the radius of said ribs, said latching members thereby being displaceable radially outwardly with respect to one another for facilitating inserting the end of a corrugated pipe within the collar and being resiliently returnable for engaging the ribs of the corrugated pipe and providing a releasable connection therewith.

15. A resilient plastic drainage pipe according to claim 14 wherein said longitudinal ribs extend over substantially the entire axial length of said collar.

16. A resilient plastic drainage pipe according to claim 14 wherein at least some of the ribs on said collar are positioned closely adjacent said latching members to thereby facilitate displacing the latching members radially outwardly with respect to one another when a pipe is inserted in the collar.

17. A resilient plastic drainage pipe according to claim 14 wherein the innermost ends of said ribs are tapered.

18. A resilient plastic drainage pipe according to claim 14 wherein the wall thickness of said collar is thinner at the outer end of the collar than at the inner end thereof to provide additional flexibility in the outer portion of the collar, and wherein said latching members are positioned in a circular arrangement in the outer, more flexible portion of the collar.

* * * * *